US007810464B2

(12) United States Patent
Samenfink et al.

(10) Patent No.: US 7,810,464 B2
(45) Date of Patent: Oct. 12, 2010

(54) PROCEDURE FOR STARTING A COMBUSTION ENGINE

(75) Inventors: Wolfgang Samenfink, Besigheim (DE); Andreas Kufferath, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/274,974

(22) Filed: Nov. 20, 2008

(65) Prior Publication Data

US 2009/0173304 A1 Jul. 9, 2009

(30) Foreign Application Priority Data

Jan. 4, 2008 (DE) ..... 10 2008 003 244

(51) Int. Cl.
*F02D 41/06* (2006.01)

(52) U.S. Cl. ..... 123/179.16; 123/179.17; 123/179.18

(58) Field of Classification Search ..... 60/336, 60/237, 39.381, 791; 123/179.16–179.19; 701/101–105, 115; *F02D 41/06*
See application file for complete search history.

(56) References Cited

U.S. PATENT DOCUMENTS 3,232,053 A * 2/1966 McCombs, Jr. et al. .. 60/39.281
4,337,617 A * 7/1982 Smith ..... 60/39.281

* cited by examiner

*Primary Examiner*—Stephen K Cronin
*Assistant Examiner*—Keith Coleman
(74) *Attorney, Agent, or Firm*—Merchant & Gould P.C.

(57) ABSTRACT

Procedure for starting a combustion engine with at least one combustion chamber, whereby injections from the high pressure system are deposited into the combustion chamber during the starting process, is thereby characterized, in that at least one injection into the combustion engine can be blanked out in order to limit a pressure drop in the high pressure system.

9 Claims, 3 Drawing Sheets

PROCEDURE FOR STARTING A COMBUSTION ENGINE

TECHNICAL FIELD

The present invention concerns a procedure for starting a combustion engine with at least one combustion chamber, whereby injections are deposited during the starting process into the combustion chamber out of a high pressure system. Furthermore the invention concerns a device for implementing such a procedure and the computer program with a program code for implementing such a procedure.

BACKGROUND

During the starting of the combustion engine with direct injection a start and a after-start enrichment is undertaken in general, whereby a fuel amount is injected that is increased compared to a normal operation. The reason for that is that a wall film can evolve on a piston head and a cylinder wall during the starting process in the combustion chamber, so that a lower fuel mass is available for the combustion. The wall film evolving is directly depending on a bad mixture formation, which can be caused by a too low pressure in a high pressure system of the injection system. Generally the described usual procedure has the disadvantage that a bigger fuel amount is required and that an unclean combustion is possible. Acquainted solution possibilities, as for example the heating of the fuel and the combustion engine before starting, are energy-intensive, time-consuming or disadvantageous in a different way.

SUMMARY

It is one task of the invention to provide an improved procedure for starting a combustion engine, whereby the disadvantages of the state of the art shall be overcome and especially an improved mixture formation or a lower fuel consumption during the starting process shall be ensured. Furthermore it is the invention's task to provide a corresponding device for implementing the procedure.

This problem is solved by a procedure for starting a combustion engine with at least one combustion chamber, whereby injections are deposited during the starting process into the combustion chamber from a high pressure system, is thereby characterized, in that at least one injection into the combustion chamber can be blanked out, in order to limit a pressure drop in the high pressure system. The invention offers the advantage that by blanking out the injection a pressure drop in the high pressure system can be obviated, whereby it has to be considered that a sufficient high pressure is required in the high pressure system (rail-pressure), in order to ensure a good mixture formation. Usually injections are deposited in periodical series into the combustion chambers by the high pressure system, whereby it a pressure drop in the high pressure system can occur due to the fuel mount that is increased during the starting process. Within the scope of the invention at least one injection, which takes place in periodical series into the combustion chamber(s), can be blanked out now.

Advantageously the injection is blanked out when the pressure falls below a minimal threshold. This minimal pressure is preferably higher than a lower threshold for the pressure in the high pressure system, at which a good mixture formation cannot be ensured anymore. This lower threshold is herein also called minimum pressure. So it is advantageous to set the limit for blanking out the injection higher than an absolute minimum level for the pressure for a secure mixture formation. A further advantageous possibility is to calculate the pressure drop for a future injection and to blank out the injection if the calculation shows that this injection would cause a pressure drop in the high pressure system below the minimum pressure. This provides the advantage of a higher guarantee, because this way it surely cannot come to a too low pressure. The injections will be started again when the pressure in the high pressure system rises above the minimum pressure or when it can be determined that a following combustion would not cause a pressure drop below the threshold (minimum pressure).

Preferably the minimum pressure is pre-defined or changes during the starting process. The change of the minimum pressure during the starting process is based on the idea that the injection amount can be successively reduced from injection to injection during the starting process. Therefore the fuel amount is also reduced during the starting process. The predefined minimum pressure provides the advantage of a regulation or controller that can be easily configured.

Advantageously, depending on the blanking out of the injection, an electric machine that is actuating the combustion engine during the starting process is operated longer or a corresponding error is send to the driver to operate the electric machine longer. The background is that by blanking out the injection the acceleration process of the crankshaft of the combustion engine until the idle engine speed lasts longer. Therefore it is necessary or advantageous to operate the electric machine longer. This can take place automatically or a corresponding hint can be given to the driver. This is especially advantageous when the surrounding conditions make a blanking out of injections likely, for example at a low temperature of the combustion engine or the oil temperature of the combustion engine or at a low fuel temperature.

Preferably the starting combustion engine provides a number of combustion chambers, whereby the blanking out of the injection takes only place in a part of the combustion chambers. This means that at least one of the combustion chambers is continuously provided with injection in a periodical series, whereby it can be adhered to the usual interval for this combustion chamber. This offers the advantage, that in the combustion chamber, in which an injection has already taken place, better temperature or combustion conditions are already present than in a combustion chamber, in which it has not been yet injected to. Therefore a blanking out of the injection preferably takes place in a combustion chamber, in which an injection has not taken place during the starting process. This way the starting process can be started initially for example with only one out of four combustion chambers and the first combustion or first injection in the other combustion chambers can take place at a later point of time.

Advantageously the following steps are implemented within the scope of the invention: injection into a first combustion chamber, checking whether an injection into a second combustion chamber would cause a pressure drop in the high pressure system below a lower threshold for the pressure, and injections in the second combustion chamber only when the checking implies that an injection into the second combustion chamber would not cause a pressure drop in the high pressure system below a lower threshold for the pressure. Thereby the injection into the second combustion chamber takes place at the usual point of time. Otherwise, if it is not injected due to the checking, at least one injection is blanked out into the second combustion chamber. The lower threshold for the pressure can be the above mentioned minimum pressure, but it can also be an absolute bottom threshold, at which a secure combustion cannot be provided anymore (minimum pressure). The procedure according to the invention can be analogously extended to a third, fourth or further combustion chamber and provides the advantage of a secure starting procedure.

Advantageously a maximum pressure regulation of the pressure in the high pressure system takes place during the starting process. Therefore it can happen that especially by blanking out injections a too high pressure is build up in the high pressure system. In order to prevent this, a maximum pressure regulation can be applied, which reduces the flow efficiency of the high pressure pump of the high pressure system in the case of a rise of the pressure in the high pressure system above a desired maximum pressure.

A further independent subject matter of the invention is a device, especially a control unit or a combustion engine, which is customized for implementing a procedure according to the invention with one or more of the above mentioned advantageous features.

A further independent subject matter of the invention is a computer program with a program code for implementing such a procedure if the program runs in a computer.

BRIEF DESCRIPTION OF THE DRAWINGS

An embodiment of the present invention is described in detail below by using the attached drawings.

DETAILED DESCRIPTION

In the following descriptions of preferred embodiments of the invention it is proceeded from a combustion engine with a number of combustion chambers, here four as a rule, whereby the fuel is injected directly into the combustion chambers over a high pressure system. The fuel can be gasoline or diesel. Such systems are sufficiently known from the state of the art and are here not further explained.

Figure 1:
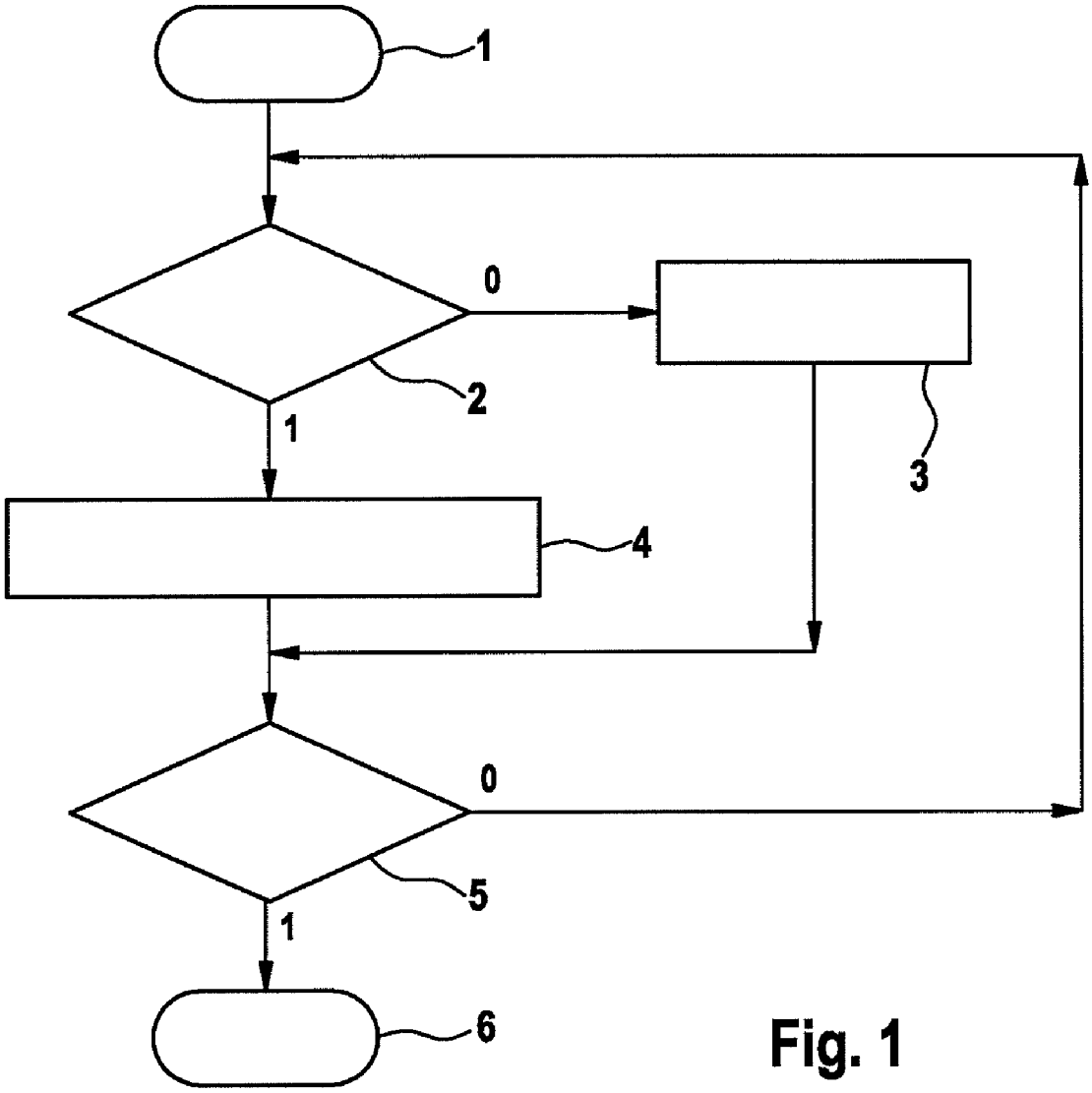
FIG. 1 shows a schematic diagram of the course of a first procedure according to the invention.

FIG. 1 shows an alternative of the procedure according to the invention. The procedure is based on an evaluation of the pressure in the high pressure system, whereby further injections are only undertaken if the pressure did not fall below a certain minimum pressure. The procedure begins in a first step 1, if a starting demand for the combustion engine is available. In a second step 2 it is checked, whether the pressure in the high pressure system is higher than the pressure that is required for the secure operation. If it is determined in step 2 that the pressure fell below the minimum pressure, the subsequent injection is blanked out in step 3. If the pressure did not fall below the minimum pressure, the injection gets deposited (step 4). Following step 3 or step 4 it is checked in step 5 whether the idle engine speed is reached and therefore the starting process is finished. If it is determined in step 5 that the idle engine speed is reached, the procedure jumps to step 6, where it ends. But if it is determined in step 5 that the idle engine speed is not reached yet, the procedure jumps back to step 2, where it is checked for the next possible injection, whether the pressure in the high pressure system is at least as high as the required minimum pressure.

The procedure is not limited to the illustrated embodiment, but it can rather be checked before each injection, which effect a following injection would have and depending on this prognosis a injection can be undertaken or blanked out. Thus it could be checked in step 2, whether the pressure fell below the minimum pressure, which lies above the minimum pressure by a safety distance. This way it could be ensured that the minimum pressure occurs in the high pressure system also during and after the injection. This would have the advantage of an even more precise maintenance of the pressure in the high pressure system.

Figure 2:
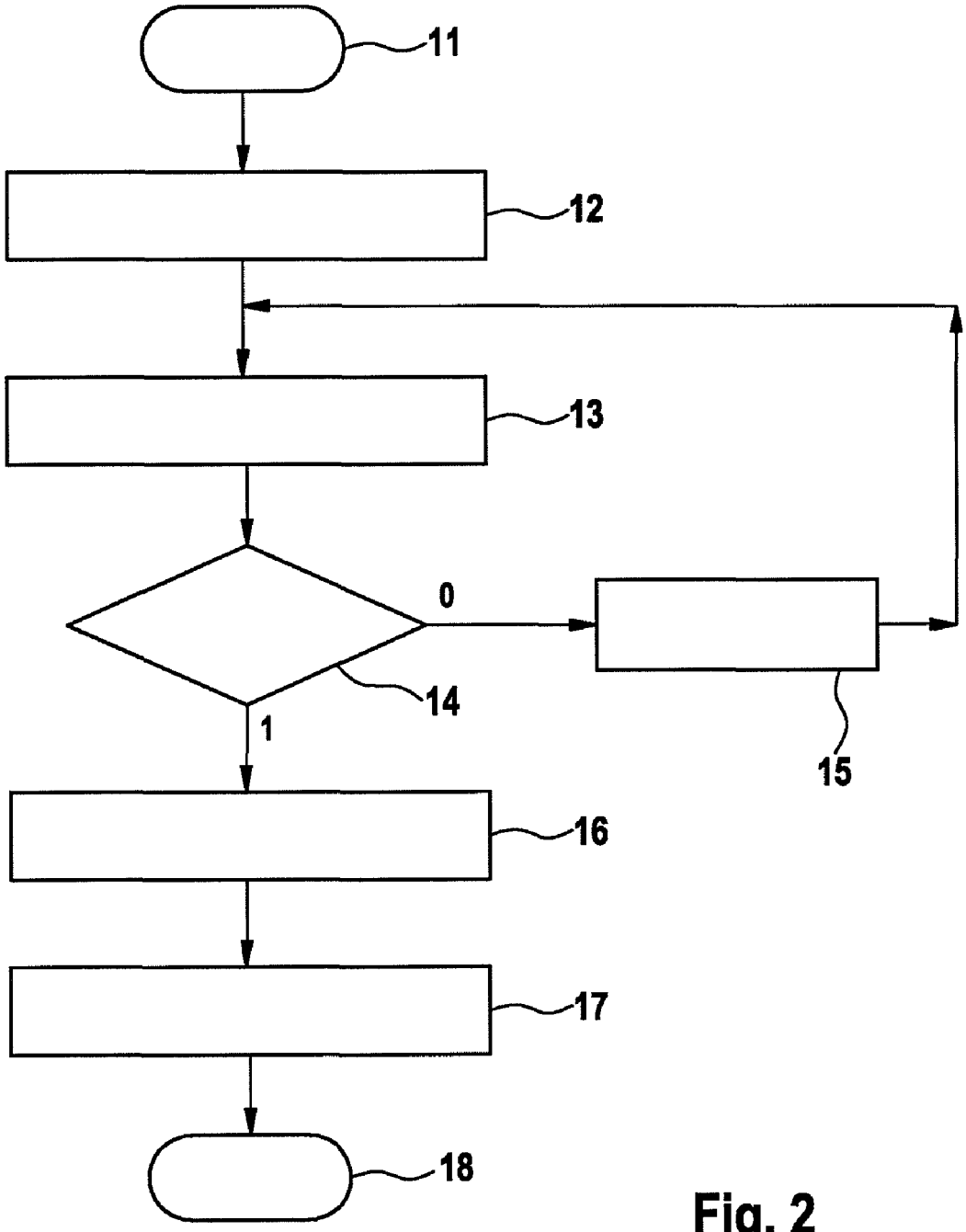
FIG. 2 shows a schematic description of the course of a second procedure according to the invention.

FIG. 2 shows a different embodiment of the invention, whereby the diagram in FIG. 2 shows a course of a procedure according to the invention, at which a defined blanking out pattern is used. The procedure that is shown in FIG. 2 on the other hand is meant to be used with one of the above described combustion engines with a high pressure injection system. Compared to the procedure in FIG. 1 the procedure in FIG. 2 offers the additional advantage that in the case of a combustion chamber that has been fired once a blanking out does not take place anymore, so that no fuel thin form of a wall film that is left from one of the previous combustions evaporates and gets lost without a combustion. Additionally it is avoided that the combustion chamber cools down. The procedure in FIG. 2 is described related to FIG. 3, which shows an ignition sequence during the course of the procedure of FIG. 2.

Figure 3:
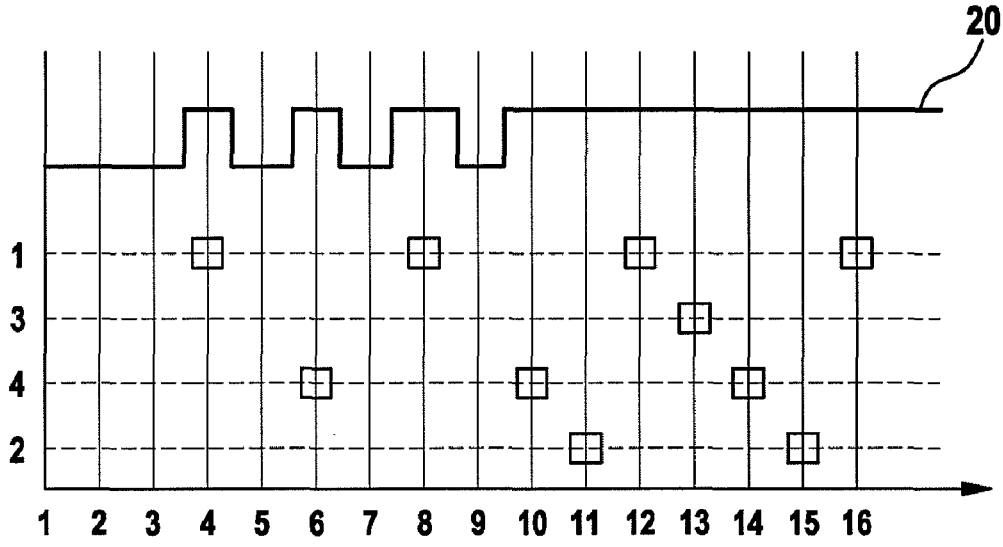
FIG. 3 shows a diagram, which illustrates an injection sequence during the implementation of the procedure that is shown in FIG. 2.

The procedure begins with a step 11 upon a starting request. In a step 12 it is started with the starting, whereby it is determined simultaneously, in which combustion chamber a first combustion can take place. In this case it is the first combustion chamber, labeled by a 1 on the vertical axis of the diagram of FIG. 3. The horizontal axis of FIG. 3 shows the ongoing clock cycle.

The first injection into the first combustion chamber takes place in a step 13, if the minimum pressure is exceeded. Subsequently it is checked, whether it is ensured with an injection into the following combustion chamber, that the necessary minimum pressure, which is required at the next work cycle for an injection in the first combustion chamber, would be also available at this later point of time, if the next possible injection is deposited into the subsequent combustion chamber. During this checking in step 14 it can be decided in an extreme case, that the three following combustion chambers are not fired during this work cycle. In such an extreme case the procedure jumps from step 15, in which the three following injections into the third, fourth and second combustion chamber are blanked out and jumps afterwards back to step 13, where an injection into the first combustion chamber takes place once again. However, a small fuel amount is injected during this second injection into the first combustion chamber due to the already heated first combustion engine, whereby this fuel reduction that can also be used for this invention is already known from the state of the art and therefore not explained anymore.

If the checking in step 14 implies, that in the meantime until the next work cycle, at which the combustion chamber 1 is fired, a further combustion chamber is provided with fuel, the procedure continues in a step 16. It is decided now in step 16, whether and when during the following work cycle the individual combustion chambers are each fired for the first time. This way it is determined in step 16 in a systematic proceeding, in which order and when the combustion chambers will be fired for the first time, whereby in the example in FIG. 3 the fourth combustion chamber is already fired during the next possible cycle. The second combustion chamber follows in the example of FIG. 3 in a further cycle.

Thus several decisions that are explained in detail above in relation to the first combustion chamber (step 14) are taken in step 16, whereby it is always decided analogously, whether a combustion chamber can be additionally fired in an actual work cycle. As soon as all combustion chambers are fired, the procedure jumps to step 17, in which it waits during further injections until an idle engine speed is reached, at which it can be assumed that the combustion engine works independently. Subsequently the procedure ends in step 18.

Figure 4:
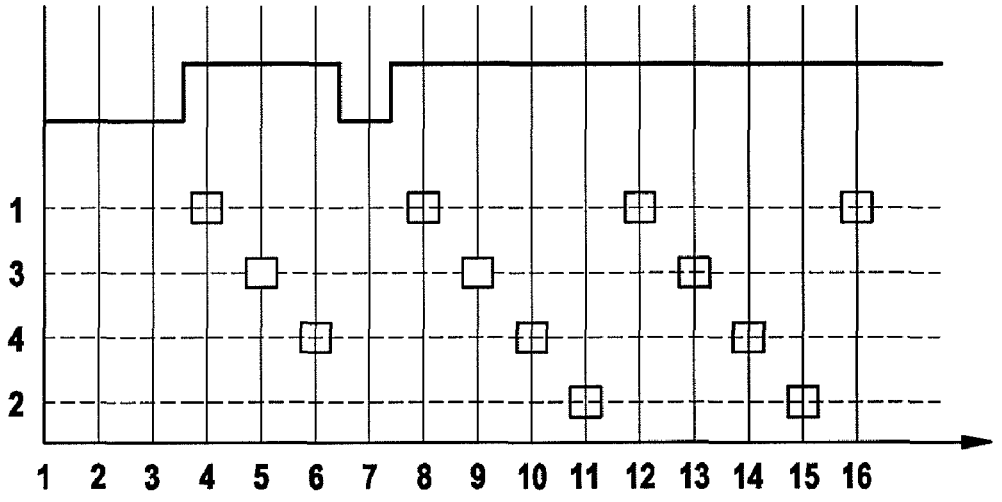
FIG. 4 shows a diagram, which illustrates another sequence of injections while implementing the procedure shown in FIG. 2.

FIG. 4 shows the implementation of the procedure of FIG. 2 under better circumstances, whereby it is determined here in step 16, that only one combustion chamber has to be blanked out during an injection in the first cycle, namely the second combustion chamber. The illustrated procedure is also applicable to other ignition orders and other combustion engines, especially with a different number of combustion chambers. The decisions that have been shown here in FIG. 2 in step 14 and in step 16, can also be taken with the aid of familiar parameters of the combustion engine, as for example with the aid of the temperature of the combustion engine and the temperature of the fuel.

The invention claimed is:

1. A method of starting a combustion engine having at least one combustion chamber, the method comprising:

selectively blanking out at least one injection in a sequence of a plurality of injections from a high pressure fuel system into the at least one combustion chamber upon a drop of pressure in the high pressure system below a minimum pressure to limit a pressure drop in the high pressure fuel system, wherein the plurality of injections are required for combustion during a starting process; and following at least one injection into the at least one combustion chamber during the starting process, evaluating an engine speed of the combustion engine to determine whether the engine speed has reached an idling speed.

2. A method according to claim 1, wherein the minimum pressure is pre-defined and/or changes during the starting process.

3. A method according to claim 1, further comprising operating an electric machine that is actuating the combustion engine during the starting process for a longer period of time depending on the blanking out of the at least one injection and/or a sending a hint to a driver.

4. A method according to claim 1, wherein upon provision of a plurality of combustion chambers the blanking out of at least one of the plurality of injections occurs only in a part of the plurality of combustion chambers.

5. A method according to claim 4, further comprising blanking out at least one of the plurality of injections in only one of the plurality of combustion chambers, wherein in the one of the plurality of combustion chambers no injection took place during the starting process.

6. A method according to claim 4, further comprising:

depositing a plurality of injections in a first combustion chamber;

determining if an injection in a second combustion chamber would cause a pressure drop in the high pressure system below a bottom threshold pressure; and depositing a plurality of injections in the second combustion chamber upon determining that an injection in the second combustion chamber would not cause a pressure drop in the high pressure system below a bottom threshold pressure.

7. A method according to claim 1, wherein a maximum pressure regulation of the pressure in the high pressure system occurs during the starting process.

8. A device, especially a control unit for a combustion engine, for the implementation of a method of starting a combustion engine having at least one combustion chamber, the method comprising: selectively blanking out at least one injection in a sequence of a plurality of injections from a high pressure fuel system into the at least one combustion chamber upon a drop of pressure in the high pressure system below a minimum pressure to limit a pressure drop in the high pressure fuel system, wherein the plurality of injections are required for combustion during a starting process, and wherein following at least one injection into the at least one combustion chamber during the starting process an engine speed of the combustion engine is evaluated to determine whether the engine speed has reached an idling speed.

9. A computer program with a program code to implement, if the computer program runs on a computer, a method of starting a combustion engine having at least one combustion chamber, the method comprising: selectively blanking out at least one injection in a sequence of a plurality of injections from a high pressure fuel system into the at least one combustion chamber upon a drop of pressure in the high pressure system below a minimum pressure to limit a pressure drop in the high pressure fuel system, wherein the plurality of injections are required for combustion during a starting process, and wherein following at least one injection into the at least one combustion chamber during the starting process an engine speed of the combustion engine is evaluated to determine whether the engine speed has reached an idling speed.

* * * * *